US008011270B2

(12) United States Patent
Schlabach et al.

(10) Patent No.: US 8,011,270 B2
(45) Date of Patent: Sep. 6, 2011

(54) INTEGRATED PEDAL ASSEMBLY HAVING A HYSTERESIS MECHANISM

(75) Inventors: Roderic A. Schlabach, Fort Wayne, IN (US); Mark Vorndran, Fort Wayne, IN (US)

(73) Assignee: Wabash Technologies, Inc., Huntington, IN (US)

( * ) Notice: Subject to any disclaimer, the term of this patent is extended or adjusted under 35 U.S.C. 154(b) by 921 days.

(21) Appl. No.: 11/716,517

(22) Filed: Mar. 9, 2007

(65) Prior Publication Data

US 2008/0149411 A1 Jun. 26, 2008

Related U.S. Application Data

(60) Provisional application No. 60/876,060, filed on Dec. 20, 2006.

(51) Int. Cl.
*G05G 1/30* (2008.04)

(52) U.S. Cl. ..... 74/512; 74/513; 74/560

(58) Field of Classification Search ..... 74/512–514; 403/147, 253, 263, 409.1, 350, 374.1; 188/381
See application file for complete search history.

(56) References Cited

U.S. PATENT DOCUMENTS

| | | | | |
|---|---|---|---|---|
| 4,915,075 | A | 4/1990 | Brown | |
| 5,385,068 | A | 1/1995 | White et al. | |
| 5,416,295 | A | 5/1995 | White et al. | |
| 5,768,946 | A | 6/1998 | Fromer et al. | |
| 6,070,490 | A * | 6/2000 | Aschoff et al. | 74/513 |
| 6,089,120 | A * | 7/2000 | Lochle et al. | 74/514 |
| 6,240,801 | B1 * | 6/2001 | Kojima et al. | 74/513 |
| 6,289,762 | B1 * | 9/2001 | Silva | 74/513 |
| 6,330,838 | B1 | 12/2001 | Kalsi | |
| 6,408,712 | B1 | 6/2002 | Bolisetty et al. | |
| 6,426,619 | B1 | 7/2002 | Pfaffenberger et al. | |
| 6,515,473 | B2 | 2/2003 | Pfaffenberger et al. | |
| 6,523,433 | B1 * | 2/2003 | Staker | 74/513 |
| 6,531,667 | B2 | 3/2003 | Becker et al. | |
| 6,577,119 | B1 | 6/2003 | Yaddehige | |
| 6,718,845 | B2 | 4/2004 | Menzies | |
| 6,725,741 | B2 | 4/2004 | Menzies | |
| 6,834,564 | B2 * | 12/2004 | Huesges et al. | 74/513 |
| 7,296,494 | B2 | 11/2007 | Caba et al. | |
| 2002/0152831 | A1 * | 10/2002 | Sakamoto et al. | 74/512 |
| 2003/0154817 | A1 * | 8/2003 | Staker | 74/513 |

(Continued)

FOREIGN PATENT DOCUMENTS

DE 197 01 637 A1 7/1998

(Continued)

*Primary Examiner* — James Pilkington
*Assistant Examiner* — Thomas Diaz
(74) *Attorney, Agent, or Firm* — Krieg DeVault LLP

(57) ABSTRACT

A pedal assembly including a pedal support and a pedal member rotatably coupled to the pedal support to allow pivotal movement of the pedal member about a pivot axis. The pedal assembly further includes a friction member having a bearing surface, and a clamp member engaged with the pedal member and having an engagement surface abutting the bearing surface of the friction member to define at least two separate and distinct surface contact regions. The pedal assembly also includes a biasing member arranged to bias the clamp member to provide frictional engagement along the separate and distinct surface contact regions to resist pivotal movement of the pedal member. In one embodiment, the clamp member is engaged with the pedal member by a sliding pivot configured to allow the clamp member to be pivotally and slidably displaced relative to the pedal member during pivotal movement of the pedal member.

30 Claims, 9 Drawing Sheets

U.S. PATENT DOCUMENTS

| | | | | |
|---|---|---|---|---|
| 2003/0226419 | A1 | 12/2003 | Yokochi et al. | |
| 2004/0149070 | A1* | 8/2004 | Solta | 74/513 |
| 2004/0237700 | A1* | 12/2004 | Wurn | 74/514 |
| 2005/0155448 | A1* | 7/2005 | Lochle et al. | 74/513 |
| 2005/0247158 | A1 | 11/2005 | Willemsen et al. | |
| 2006/0185469 | A1 | 8/2006 | Schlabach | |
| 2007/0103149 | A1 | 5/2007 | Horie et al. | |

FOREIGN PATENT DOCUMENTS

| | | | |
|---|---|---|---|
| DE | 101 35 537 | A1 | 1/2003 |
| EP | 0 738 622 | A2 | 10/1996 |
| EP | 1 153 785 | A1 | 11/2001 |
| EP | 1 302 833 | A2 | 4/2003 |
| WO | WO 01/81110 | A1 | 11/2001 |

* cited by examiner

INTEGRATED PEDAL ASSEMBLY HAVING A HYSTERESIS MECHANISM

CROSS REFERENCE TO RELATED APPLICATIONS

The present application claims the benefit of U.S. Provisional Patent Application Ser. No. 60/876,060 filed Dec. 20, 2006, the entire contents of which are hereby incorporated by reference.

FIELD OF THE INVENTION

The present invention relates generally to the field of pedal assemblies for use in association with vehicles, and more particularly relates to an integrated pedal assembly having a hysteresis mechanism.

SUMMARY OF THE INVENTION

While the actual nature of the invention covered herein can only be determined with reference to the claims appended hereto, certain forms of the invention that are characteristic of the preferred embodiments disclosed herein are described briefly as follows.

In one form of the present invention, a pedal assembly is provided for use in association with a vehicle, including a pedal support adapted for mounting to the vehicle, a pedal member including a lever portion and a mounting portion rotatably coupled to the pedal support to allow pivotal movement of the pedal member about a pivot axis, a friction member having a bearing surface, a clamp member engaged with the pedal member and having an engagement surface abutting the bearing surface of the friction member to define at least two separate and distinct surface contact regions angularly offset from one another relative to the pivot axis, and a biasing member arranged to apply a biasing force to the clamp member to bias the clamp member toward the friction member to provide frictional engagement along the separate and distinct surface contact regions to resist pivotal movement of the pedal member.

In another form of the present invention, a pedal assembly is provided for use in association with a vehicle, including a pedal support adapted for mounting to the vehicle, a pedal member including a lever portion and a mounting portion rotatably coupled to the pedal support to allow pivotal movement of the pedal member about a pivot axis, a friction member having a bearing surface, a clamp member, and a biasing member. The clamp member includes a yoke portion, an engagement surface facing the bearing surface of the friction member, and a flange portion generally aligned with the yoke portion. The yoke portion is defined by pair of pedal mounting portions with the lever portion of the pedal member positioned within the yoke portion and with the mounting portions positioned in engagement with corresponding portions of the lever portion. The biasing member is arranged to apply a centralized biasing force to the flange portion of the clamp member to bias the clamp member toward the friction member to provide frictional engagement between the engagement surface and the bearing surface to resist pivotal movement of the pedal member.

In another form of the present invention, a pedal assembly is provided for use in association with a vehicle, including a pedal support adapted for mounting to the vehicle, a pedal member including a lever portion and a mounting portion rotatably coupled to the pedal support to allow pivotal movement of the pedal member about a pivot axis, a friction member having a conically-shaped bearing surface extending generally about the pivot axis, a clamp member engaged with the pedal member and having a conically-shaped engagement surface facing the conically-shaped bearing surface of the friction member, and a biasing member arranged to apply a biasing force to the clamp member to bias the clamp member toward the friction member to provide frictional engagement between the conically-shaped engagement surface and the conically-shaped bearing surface to resist pivotal movement of the pedal member.

In another form of the present invention, a pedal assembly is provided for use in association with a vehicle, including a pedal support adapted for mounting to the vehicle, a pedal member including a lever portion and a mounting portion, a pivot member extending along a pivot axis and being non-rotatably coupled with the mounting portion of the pedal member and rotatably coupled to the pedal support to allow pivotal movement of the pedal member about the pivot axis, a friction member having a bearing surface, a clamp member engaged with the pedal member and having an engagement surface facing the bearing surface of the friction member, a biasing member arranged to apply a biasing force to the clamp member to bias the clamp member toward the friction member to provide frictional engagement between the engagement surface and the bearing surface to resist pivotal movement of the pedal member, a magnetic field generator providing a magnetic field and coupled to the pivot member and arranged generally along the pivot axis such that pivotal movement of the pedal member results in corresponding rotational displacement of the magnetic field about the pivot axis, and a magnetic sensor device comprising at least one magnetic flux sensor arranged generally along the pivot axis and positioned within the magnetic field to sense variations in the magnetic field during the rotational displacement and to generate an output signal representative of a rotational position of the magnetic field relative to the at least one magnetic flux sensor.

DESCRIPTION OF THE PREFERRED EMBODIMENTS

Figure 1:
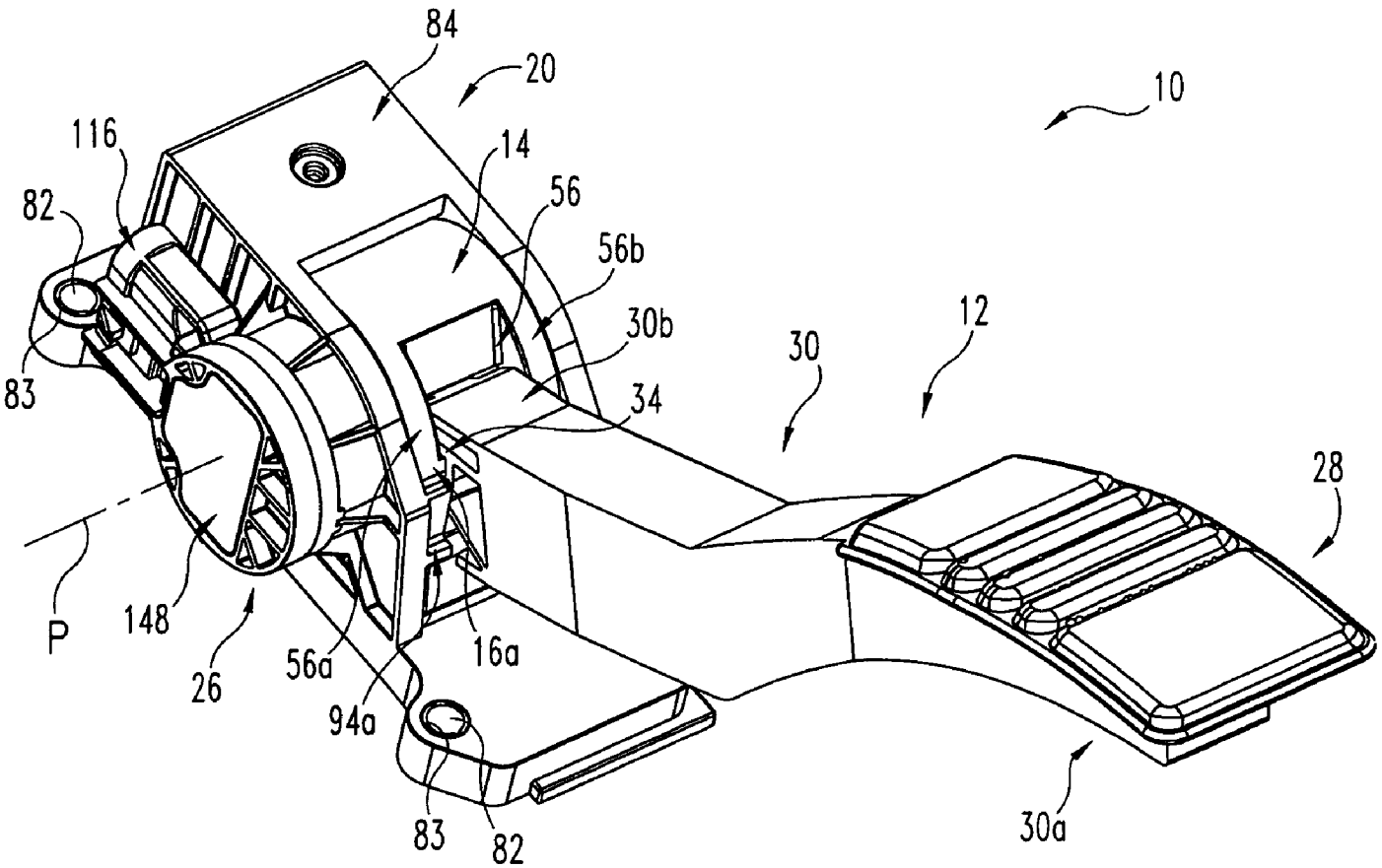
FIG. 1 is a perspective view of a pedal assembly according to one form of the present invention.

For the purposes of promoting an understanding of the principles of the invention, reference will now be made to the embodiments illustrated in the drawings and specific language will be used to describe the same. It will nevertheless be understood that no limitation of the scope of the invention is hereby intended, and that alterations and further modifications to the illustrated devices and/or further applications of the principles of the invention as illustrated herein are contemplated as would normally occur to one skilled in the art to which the invention relates.

Figure 2:
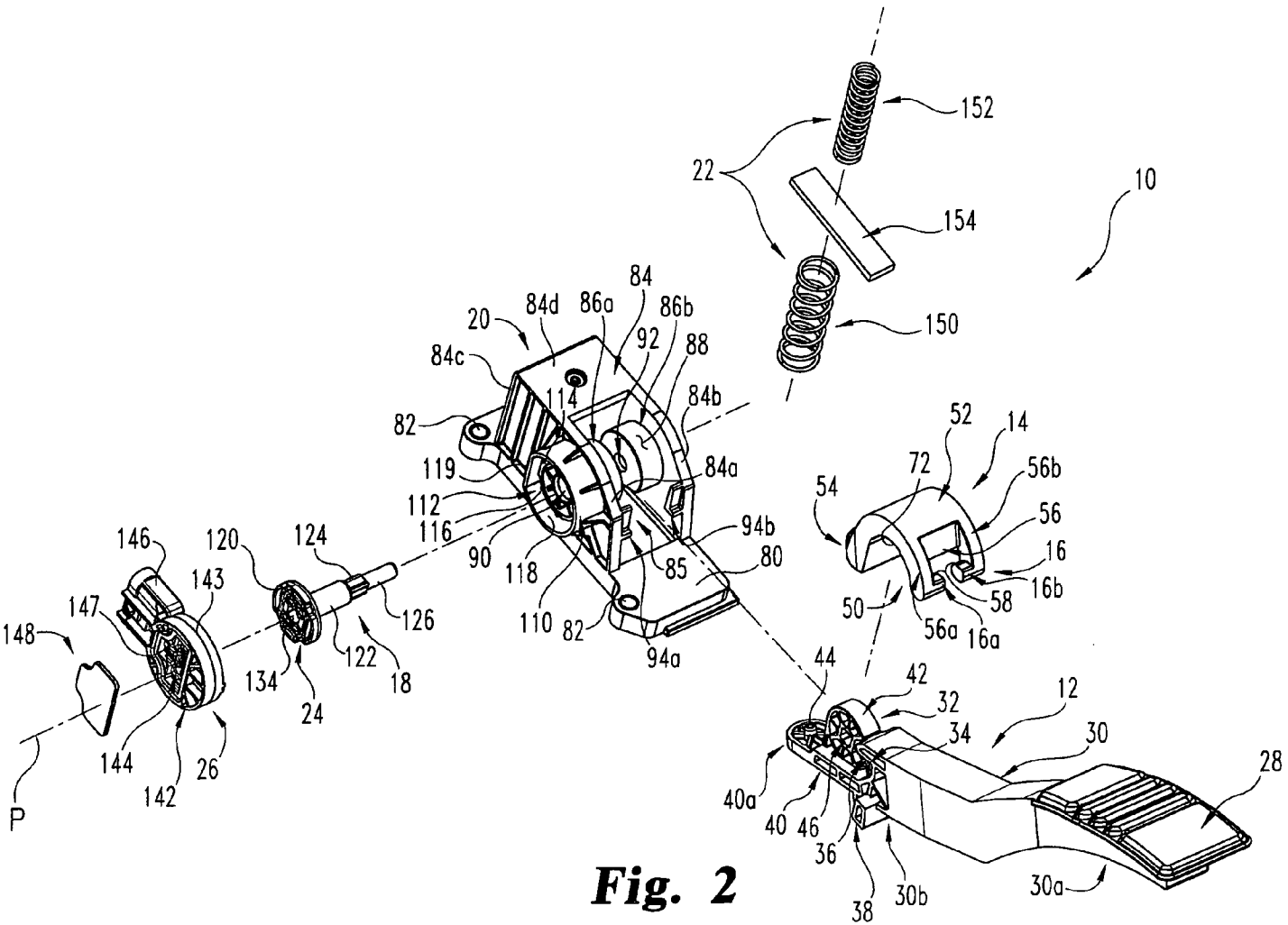
FIG. 2 is an exploded perspective view of the pedal assembly illustrated in FIG. 1.

Referring to FIGS. 1 and 2, shown therein is a pedal assembly 10 according to one form of the present invention. The pedal assembly 10 is generally comprised of a pedal arm 12, a clamp arm or drum 14 engaged to the pedal arm 12 via one or more engagement elements 16, a pivot element 18 for pivotally coupling the pedal arm 12 with a pedal support or housing 20 for pivotal movement about a pivot axis P, and a biasing mechanism 22 engaged between a portion of the clamp arm 14 and the pedal support 20 to bias the clamp arm 14 into engagement with a frictional element associated with the pedal support 20. The pedal assembly 10 is equipped with a magnetic circuit 24 and a non-contact magnetic sensor device 26 for sensing changes in the rotational position of the magnetic field generated by the magnetic circuit 24. A pedal pad 28 may be attached to the pedal arm 12 to facilitate application of an activation force $F_A$ onto the pedal arm 12 by the operator of the vehicle to correspondingly pivot the pedal arm 12 about the pivot axis P.

The pedal support 20 is adapted for mounting to a vehicle, such as, for example, to the bulkhead or firewall of an automobile. In one embodiment, the pivot element 18 is non-rotatably coupled to the pedal arm 12 and rotatably coupled to the pedal support 20 to pivotally couple the pedal arm 12 to the pedal support 20 for pivotal movement about the pivot axis P. Additionally, in a further embodiment, the magnetic circuit 24 is non-rotatably engaged with a portion of the pivot element 18 such that pivotal movement of the pedal arm 12 about the pivot axis P correspondingly results in rotational displacement of the magnetic field generated by magnetic circuit 24 relative to the sensor device 26. The sensor device 26 is preferably non-rotatably coupled with the pedal support 20 and senses variations in the magnetic field during rotational displacement of the magnetic circuit 24 in response to pivotal movement of the pedal arm 12, and also generates an output signal representative of the relative rotational position of the magnetic field and the pivotal position of the pedal arm 12. In one embodiment of the invention, the pedal assembly 10 is used in an automotive vehicle such as, for example, in association with an accelerator pedal to generate an electronic control signal corresponding to the pivotal position of the pedal arm 12 relative to the pedal support 20, with the electronic signal controlling operation of a throttle valve. However, it should be understood that the pedal assembly 10 may also be used in association with other types of pedals to control other functions of a vehicle, such as, for example, braking or shifting. It should also be understood that the pedal assembly 10 may be used in areas outside of the automotive field. Further details regarding the components and operation of the pedal assembly 10 will be discussed in greater detail below.

Figure 3:
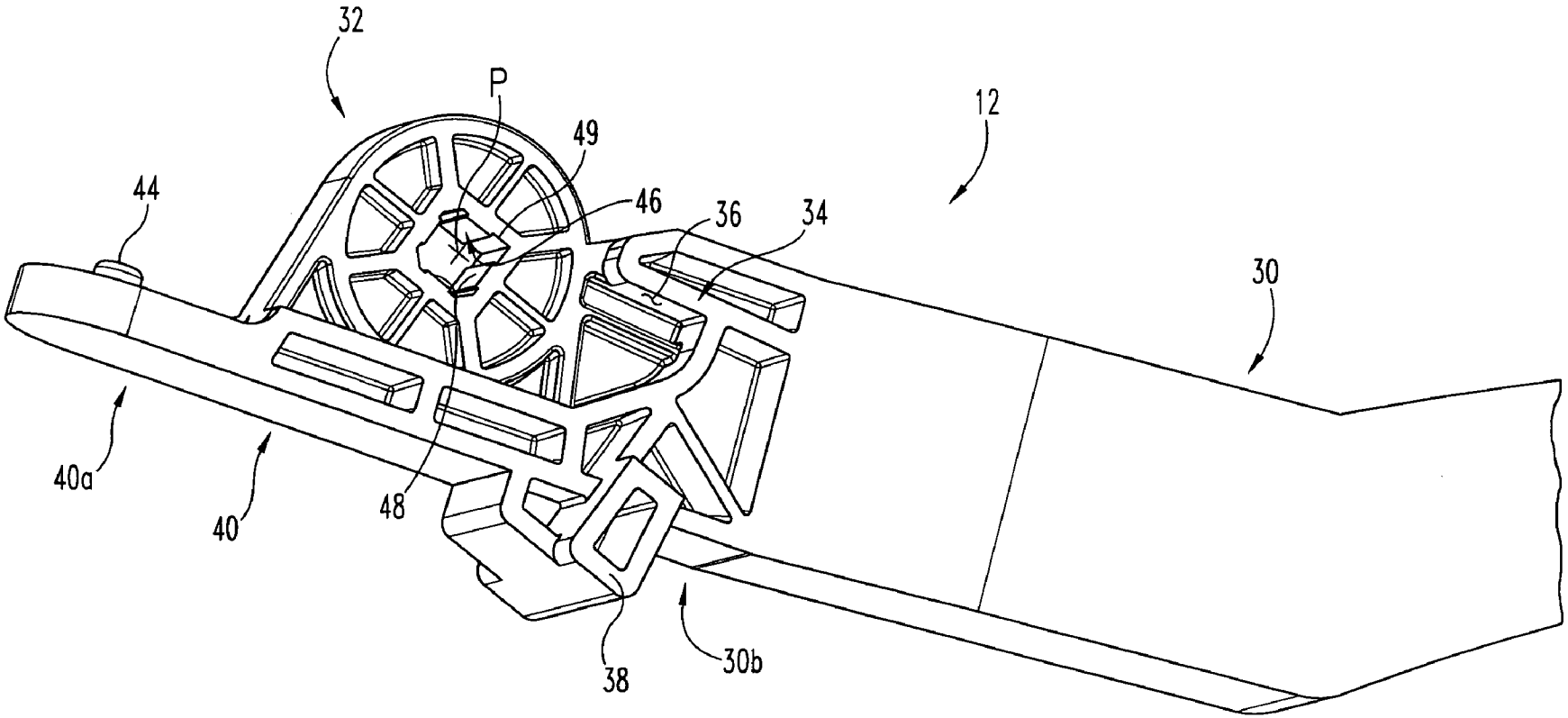
FIG. 3 is a side perspective view of a proximal portion of the pedal arm illustrated in FIGS. 1 and 2.

Referring to FIGS. 2 and 3, in one embodiment of the invention, the pedal arm 12 may be formed from a plastic or polymeric based material, and may be formed via various molding techniques including, for example, injection molding. However, in other embodiments, the pedal arm 12 may be formed of metallic materials or composite materials and/or may be formed via various machining or casting techniques. Additionally, various portions of the pedal arm 12 may be provided with a honeycomb configuration defining a number of recesses or voids to reduce weight while at the same time maintaining the requisite strength and structural integrity.

Figure 8:
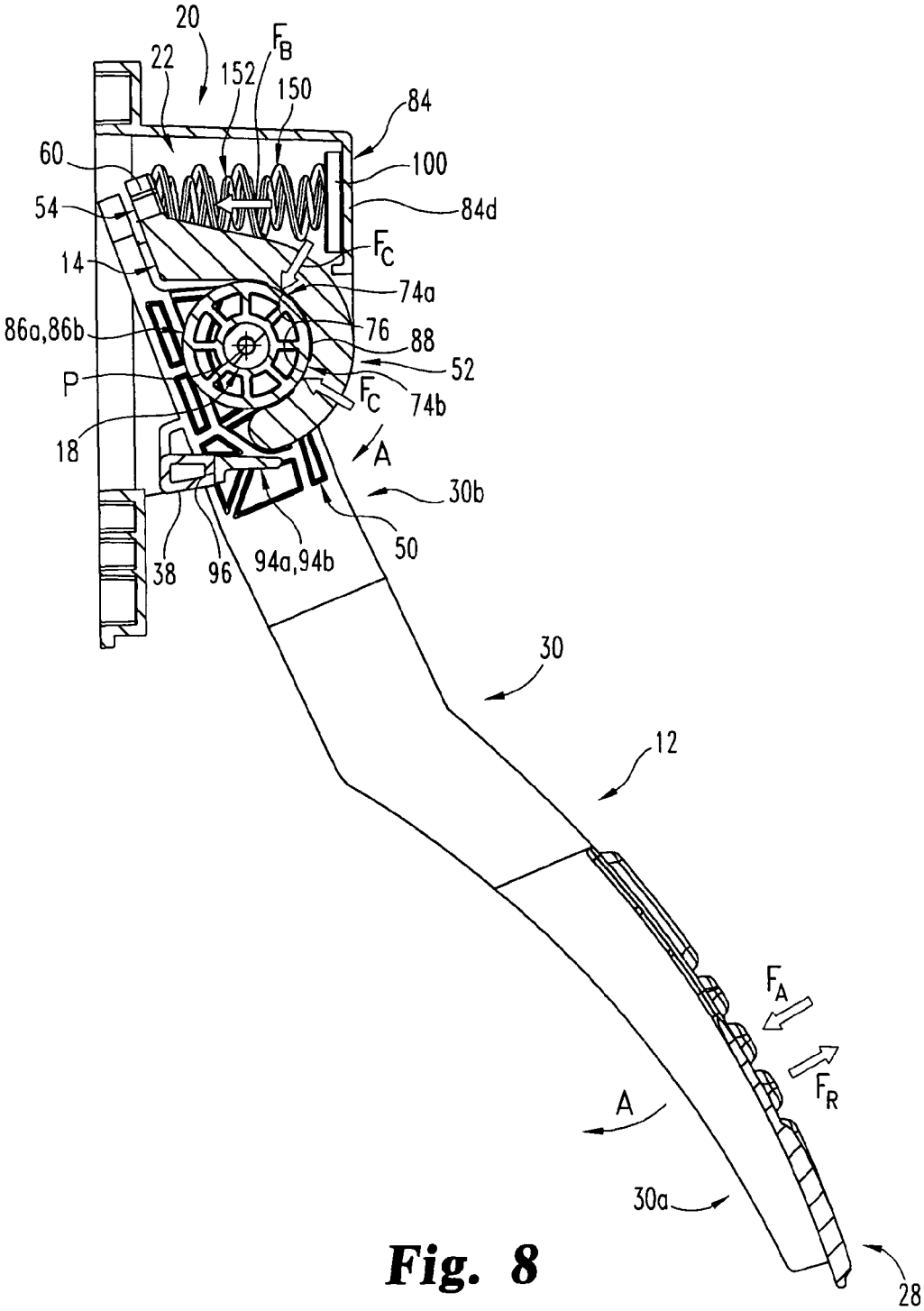
FIG. 8 is a cross sectional view of the pedal assembly illustrated in FIGS. 1 and 2.

In the illustrated embodiment of the pedal assembly 10, the pedal arm 12 includes an elongated lever portion 30 and a mounting portion 32, with the pedal pad 28 attached to the distal lever portion 30*a* and with the mounting portion 32 positioned adjacent the proximal lever portion 30*b*. Although a single side of the pedal arm 12 is illustrated in FIGS. 2 and 3, it should be understood that the pedal arm 12 is somewhat symmetrical relative to a central plane, with similar features included on the opposite side of the pedal arm 12. The distal lever portion 30*a* extends from the remainder of the lever portion 30 at an angle; however, other configurations are also contemplated. The proximal lever portion 30*b* includes a lateral projection or protrusion 34 which provides a ledge or shoulder defining an abutment. The abutment 34 preferably has a generally linear or planar bearing surface 36. As will be discussed below, the engagement elements 16 associated with the clamp arm 14 abuttingly engage the bearing surfaces 36 during pivotal movement of the pedal arm 12 to compress the clamp arm 14 against a frictional element associated with the pedal support 20. The proximal lever portion 30*b* also includes a bar 38 extending across the width of the proximal lever portion 30*b* and beyond the sides of the proximal lever portion 30*b*. The bar 38 is positioned within the pedal support 20 and engages a pair of stops 94*a*, 94*b* extending from the pedal support 20 (FIGS. 2 and 5) to limit pivotal movement of the pedal arm 12 relative to the pedal support 20 in a return direction opposite arrow A. (FIG. 8).

The mounting portion 32 of the pedal arm 12 includes a base 40 and a mounting flange 42 projecting from the base 40. The base 40 includes an end portion 40*a* from which extends a stem 44. The mounting flange 42 defines an axial passage 46 extending therethrough and generally arranged along the pivot axis P. As will be discussed in further detail below, the axial passage 46 is configured to receive the pivot element 18 therethrough to mount the pedal arm 12 to the pedal support 20 to provide for pivotal movement of the pedal arm 12 about the pivot axis P. In one embodiment of the invention, the axial passage has a non-circular or keyed configuration for mating engagement with a keyed shaft portion of the pivot element 18 to non-rotatably couple the pedal arm 12 to the pivot element 18. In the illustrated embodiment, the axial passage 46 has a generally square-shaped configuration and includes splines 48 that are matingly received within grooves formed along the pivot element 18. Additionally, the axial passage 46 is preferably configured to limit insertion of the pivot element 18 to a select orientation to ensure proper orientation of the pivot element 18 and the associated magnetic circuit 24 relative to the pedal arm 12, and in turn the pedal support 20 and the magnetic sensor device 26. In the illustrated embodiment, a corner 49 of the axial passage 46 is fully cut out, with the other corners being partially cut out. The portion of the pivot element 18 received within the axial passage 46 is provided with a similar configuration wherein one corner of the pivot element 18 is square and the other corners are partially removed. Although a particular shape and configuration of the axial passage 46 and the pivot element 18 have been illustrated and described herein, it should be understood that other shapes and configurations are also contemplated as falling within the scope of the present invention.

Figure 4A:
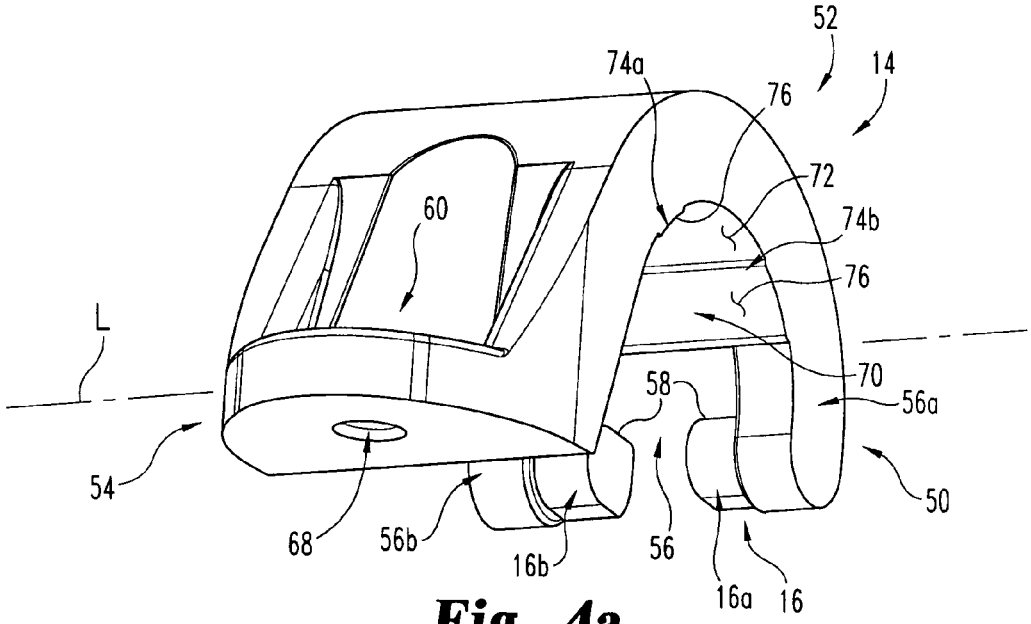
FIG. 4*a* is a side perspective view of the clamp arm illustrated in FIGS. 1 and 2.
Figure 4B:
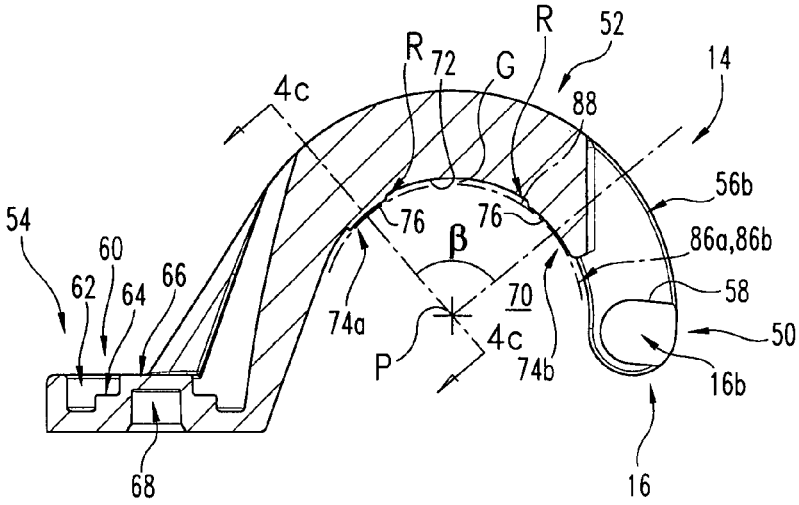
FIG. 4*b* is a cross sectional view of the clamp arm illustrated in FIG. 4*a* and showing the bearing shaft portions of the pedal support in phantom.

Referring to FIGS. 2, 4*a* and 4*b*, in one embodiment of the invention, the clamp arm 14 may be formed from a plastic or polymeric based material, and may be formed via various molding techniques including, for example, injection molding. However, in other embodiments, the clamp arm 14 may be formed of metallic materials or composite materials and/or may be formed via various machining or casting techniques. In the illustrated embodiment of the pedal assembly 10, the clamp arm 14 extends along a longitudinal axis L and includes a mounting portion 50 configured for mounting engagement with the pedal arm 12, a bearing portion or shoe 52 configured for frictional engagement with a corresponding frictional member associated with the pedal support 20, and a flange portion or spring base 54 configured for abutting engagement with the biasing mechanism 22.

The mounting portion 50 includes a yoke 56 extending along the longitudinal axis L, with the yoke 56 defined by a pair of oppositely disposed pedal mounting portions 56*a*, 56*b* arranged on opposite sides of the longitudinal axis L. In a preferred embodiment, the clamp arm 14 is provided with a pair of engagement elements or fulcrums 16*a*, 16*b* projecting inwardly from the mounting portions 56*a*, 56*b* in an opposing manner. In one embodiment, the fulcrums 16*a*, 16*b* have a non-circular or oblong configuration defining smooth and substantially planar engagement surfaces 58. However, it should be understood that other configurations, including a circular configuration, are also contemplated. The yoke 56 defined by the mounting portion 50 is sized to receive the proximal portion 30*b* of the pedal lever 30 therein, with the fulcrums 16*a*, 16*b* positioned adjacent the abutments or shoulders 34 extending from the proximal lever portion 30*b* for sliding and pivotal contact of the fulcrums 16*a*, 16*b* against the abutments 34.

The fulcrums 16*a*, 16*b* and the abutments 34 are configured to provide a sliding pivot between the pedal arm 12 and clamp arm 14. In other words, the clamp arm 14 is not coupled to the pedal arm 12 via a conventional pivot pin which would prevent sliding movement of the clamp arm 14 relative to the pedal arm 12, and would limit movement to pivoting movement about a single, non-variable pivot axis. Instead, the fulcrums 16*a*, 16*b* are allowed to slide along the bearing surfaces 36 defined by the abutments 34, while at the same time allowing pivotal movement of the clamp arm 14 relative to the pedal arm 12. The sliding pivot between the fulcrums 16*a*, 16*b* and the abutments 34 allow pivotal movement of the clamp arm 14 relative to the pedal arm 12 about a variable pivot axis that is displaceable in a direction generally along the bearing surfaces 36 of the abutments 34. Sliding displacement of the fulcrums 16*a*, 16*b* along the abutments 34 provides an extra degree of freedom or axial movement between the clamp arm 14 and the pedal arm 12 in addition to pivotal movement about the pivot axis. Additional details regarding the sliding pivot between the fulcrums 16*a*, 16*b* of the clamp arm 14 and the abutments 34 of the pedal arm 12 will be set forth below.

The flange portion or spring base 54 extends from the bearing portion 52 and is centrally positioned along the longitudinal axis L in general alignment with the yoke 56 defined by the mounting portion 50. As will be discussed below, in one embodiment of the invention, the biasing mechanism 22 comprises a pair of nested coil springs 150, 152 arranged generally concentric to one another. In order to maintain the coil springs 150, 152 in position relative to the pedal arm 12, the flange portion or spring base 54 is provided with a spring retainer 60. In the illustrated embodiment, the spring retainer 60 is configured as a cylindrical recess 62 including a first projection 64 extending from the bottom of the cylindrical recess 62 and a second projection 66 extending from the first projection 64. The cylindrical recess 62 preferably has an inner diameter somewhat larger than the outer diameter of the larger coil spring 150, the first projection 64 preferably has an outer diameter substantially corresponding to the inner diameter of the larger coil spring 150, and the second projection 66 preferably has an outer diameter substantially corresponding to the inner diameter of the smaller coil spring 152. As should be appreciated, positioning of the larger coil spring 150 within the cylindrical recess 62 and about the first projection 64 maintains the larger coil spring 150 in position relative to the clamp arm 14. Similarly, positioning of the smaller coil spring 152 about the second projection 66 maintains the smaller coil spring 152 in position relative to the clamp arm 14 and relative to the larger coil spring 150.

In one embodiment, the flange portion or spring base 54 defines a second recess 68 arranged generally opposite the spring retaining recess 62 which is sized to receive the stem 44 extending from the end portion 40*a* of the pedal arm 12 to maintain general alignment of the clamp arm 14 relative to the pedal arm 12. However, a reverse embodiment is also contemplated wherein the flange portion or spring base 54 may define a stem sized for receipt within a recess defined in the end portion 40*a* of the pedal arm 12 to maintain general alignment of the clamp arm 14 relative to the pedal arm 12. Notably, the end portion 40*a* of the pedal arm 12 is not rigidly engaged to the flange portion or spring base 54 of the clamp arm 14. Instead, the stem 44 is freely displaced within the recess 68 to correspondingly allow movement between the pedal arm end portion 40*a* and the clamp arm flange portion 54.

Although the illustrated embodiment of the pedal assembly 10 depicts the mounting portion 50 and the engagement elements or fulcrums 16*a*, 16*b* positioned adjacent the proximal end 30*b* of the lever arm 30, and the flange portion or spring base 54 arranged generally opposite the mounting portion 50, it should be understood that the positions of the mounting portion 50 and the flange portion 54 may be reversed, with the flange portion 54 (and the coil springs 150, 152) positioned adjacent the proximal lever portion 30*b* and the mounting portion 50 (and the abutments 34) arranged generally opposite the flange portion or spring base 54. Other alternative positions and orientations of the mounting portion 50 and the flange portion or spring base 54 are also contemplated.

The bearing portion or shoe 52 includes a passage 70 extending therethrough and defining a concave inner surface 72 from which extends a pair of raised projections or plateaus 74*a* and 74*b*, each defining a separate and distinct frictional engagement surface 76, thereby providing the clamp arm 14 with separate and distinct frictional engagement regions or patches extending generally about the pivot axis P. In one embodiment, the raised projections or plateaus 74*a*, 74*b* are formed integral with the clamp arm 14 to define a single piece, unitary structure. However, in another embodiment, the raised projections or plateaus 74*a*, 74*b* may be formed separately from the clamp arm 14 and subsequently attached thereto via a press fit technique, a tongue-and-groove technique, by bonding, adhering or fastening, or by any other attachment technique known to those of skill in the art. In the illustrated embodiment, the concave inner surface 72 has a generally circular configuration including a center of curvature that is positionable generally along the pivot axis P. However, other shapes and configurations of the passage 70 are also contemplated as falling within the scope of the present invention. Additionally, although the clamp arm 14 is configured such that the concave inner surface 72 extends approximately 180 degrees (including across the mounting portions 56*a*, 56*b* of the yoke 56), other embodiments are also contemplated wherein the inner surface 72 may extend up to a full 360 degrees or less than 180 degrees. Additionally, although the illustrated embodiment of the clamp arm 14 includes a pair of the raised projections or plateaus 74*a*, 74*b*, it should be understood that the clamp arm 14 may be provided with any number of projections/plateaus, including a single projection/plateau or three or more projections/plateaus. In still other embodiments, the clamp arm 14 need not include and projections/plateaus. Instead, the frictional engagement surface(s) 76 may be defined by the inner concave surface 72 of the clamp arm 14 surrounding the passage 70.

In the illustrated embodiment of the clamp arm 14, the frictional engagement surfaces 76 of the projections or plateaus 74*a*, 74*b* have an arcuate configuration, and preferably a generally circular configuration including a center of curvature that is positionable generally along the pivot axis P. In one embodiment, the frictional engagement surfaces 76 define a curvature that closely corresponds to the curvature of an outer circumferential bearing surfaces 88 defined by frictional elements or bearing shafts 86*a*, 86*b* associated with the pedal housing 84. In the illustrated embodiment of the invention, the frictional elements or bearing shafts 86*a*, 86*b* are defined by the pedal support 20. However, it should be understood that the frictional elements or bearing shafts 86*a*, 86*b* may also be defined by other elements or structures associated with the pedal assembly 10. Additionally, as illustrated in FIG. 4*b*, the raised projections or plateaus 74*a*, 74*b* are angularly offset or separated from one another by an angle β. In one embodiment, the offset or separation angle β falls within a range of between about 10 degrees and 180 degrees. In a more specific embodiment, the separation angle β falls within a range of between about 30 degrees and 150 degrees. In a more specific embodiment, the separation angle β falls within a range of between about 45 degrees and 135 degrees. In a still more specific embodiment, the separation angle β falls within a range of between about 60 degrees and 120 degrees. In a particular embodiment, the separation angle β is approximately 90 degrees. However, it should be understood that other separation angles β are also contemplated as falling within the scope of the present invention.

In the illustrated embodiment of the clamp arm 14, the frictional engagement surfaces 76 are substantially smooth. However, it should be understood that the frictional engagement surfaces 76 may be roughened to increase frictional engagement between the engagement surfaces 76 and the outer bearing surfaces 88 defined by the frictional elements or shafts 86*a*, 86*b*. Additionally, in the illustrated embodiment, the plateaus 74*a*, 74*b* and the frictional engagement surfaces 76 extend across the entire width of the clamp arm 14 in a generally uniform and uninterrupted manner. However, it should also be understood that the plateaus 74*a*, 74*b* and the frictional engagement surfaces 76 need only extend across or along select portions of the clamp arm 14, and may be interrupted or modified to provide partial or multiple surface contact regions. As should be appreciated, such interruptions or modifications to the frictional engagement surfaces 76 could be provided to change the frictional resistance characteristics associated with the pedal arm assembly 10, and possibly other characteristics including pedal performance, durability, consistency, life span, etc. In one alternative embodiment of the invention, the frictional engagement surfaces 76 may be interrupted by one or more grooves, recessed areas, or surface depressions. In one specific embodiment, such grooves, recessed areas or surface depressions may extend in a circumferential direction (i.e., across the width of the plateaus 74*a*, 74*b*), an axial direction (i.e., along the length of the plateaus 74*a*, 74*b*), and/or in any other direction. In another alternative embodiment, the frictional engagement surfaces 76 may be may be provided with surface depressions configured as dimples or flattened areas.

Figure 5:
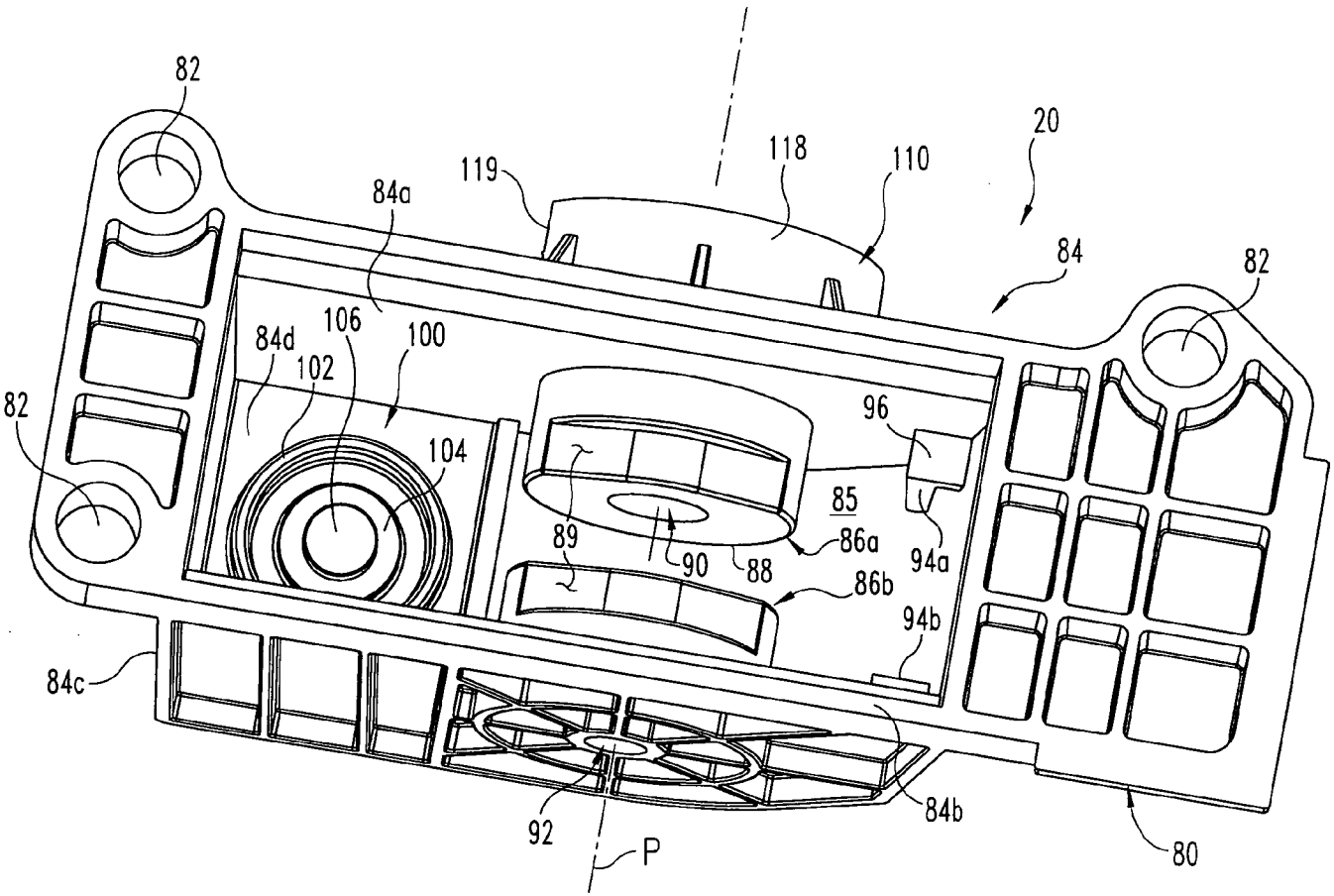
FIG. 5 is a bottom perspective view of the pedal housing illustrated in FIGS. 1 and 2.

Referring to FIGS. 2 and 5, in one embodiment of the invention, the pedal support 20 may be formed from a plastic or polymeric based material, and may be formed via various molding techniques including, for example, injection molding. However, in other embodiments, the pedal support 20 may be formed of metallic materials or composite materials and/or may be formed via various machining or casting techniques. Additionally, various portions of the pedal support 20 may be provided with a honeycomb configuration defining a number of recesses or voids to reduce weight while at the same time maintaining the requisite strength and structural integrity.

In the illustrated embodiment of the pedal assembly 10, the pedal support 20 includes one or more mounting plates or rails 80 adapted to mount the pedal support 20 to a substrate. Specifically, the mounting plate(s) 80 define a number of apertures 82 for receiving a corresponding number of fasteners, such as bolts or screws, for mounting the pedal assembly 10 to the substrate. If the pedal support 20 is formed from a plastic or polymeric material, metallic inserts 83 (FIG. 1) may be positioned within the apertures to provide additional strength and wear resistance. The inserts 83 may be molded or formed directly into the mounting plate(s) 80, may be formed via a rolling technique and pressed into the apertures 82, or may be formed via other techniques known to those of skill in the art and attached to the mounting plate(s) 80. The pedal support 20 further includes a housing 84 including a pair of opposite side walls 84*a*, 84*b*, an end wall 84*c* and a top wall 84*d*. The housing 84 further defines an opening 85 through which extends the lever portion 30 of the pedal arm 12. The bottom of the housing 84 may remain open or may be entirely or partially closed off by a lid or cover.

In the illustrated embodiment of the invention, the pedal support 20 is provided with one or more frictional elements in the form of bearing shafts 86*a*, 86*b*, each defining an outer circumferential bearing surface 88 for engagement by the frictional engagement surfaces 76 defined by the clamp arm 14. The bearing shafts 86*a*, 86*b* further define a flattened or truncated surface 89 positioned generally opposite the outer bearing surface 88 to provide clearance for the base portion 40 of the pedal arm 12. The bearing shafts 86*a*, 86*b* extend inwardly from the housing side walls 84*a*, 84*b* in an opposing manner and are preferably arranged generally along the pivot axis P. Although the pedal support 20 is illustrated as including a pair of the bearing shafts 86*a*, 86*b*, each having a substantially identical configuration, it should be understood that the pedal support 20 may alternatively be provided with a single bearing shaft and/or other types and configurations of bearing elements. In the illustrated embodiment, the bearing shafts 86*a*, 86*b* are formed integral with the pedal support 20 to define a single-piece, unitary structure. However, in other embodiments of the invention, the bearing shafts 86*a*, 86*b* may be formed separately and subsequently attached to the pedal support 20 by one or more fasteners or by other attachment techniques.

In one embodiment, the outer circumferential bearing surfaces 88 defined by the bearing shafts 86*a*, 86*b* has a generally circular configuration including a center of curvature positioned generally at the pivot axis P. However, other shapes and configurations of the outer bearing surfaces 88 are also contemplated as falling within the scope of the present invention. Additionally, although the outer bearing surfaces 88 extend about over 180 degrees of the bearing shafts 86*a*, 86*b*, other embodiments are also contemplated wherein the outer bearing surfaces 88 may extend about less than 180 degrees of the bearing shafts 86*a*, 86*b*. Additionally, although the outer bearing surfaces 88 are preferably substantially smooth, it should be understood that in alternative embodiments, the outer bearing surfaces 88 may be provided with projections or plateaus similar to those discussed above with regard to the clamp arm 14, and/or may be roughened or interrupted to increase frictional engagement with the engagement surfaces 76 of the clamp arm 14.

In the illustrated embodiment of the pedal support 20, a first axial passage 90 extends through the bearing shaft 86*a* for receipt of a first journal portion 122 of the pivot element 18, and a second axial passage 92 extending through at least a portion of the bearing shaft 86*b* for receipt of a second journal portion 126 of the pivot element 18. The first and second axial passages 90, 92 are preferably circular and arranged along the pivot axis P. The axial passages 90, 92 effectively serve as bearings to journal the pivot element 18 to allow for rotation of the pivot element 18 about the pivot axis P in response to pivotal movement of the pedal arm 12. The pedal support 20 is also provided with stops 94*a*, 94*b* extending inwardly from the housing side walls 84*a*, 84*b* in an opposing manner and each defining a stop surface 96. The stops 94*a*, 94*b* are positioned and arranged for engagement of the bar 38 extending from the pedal arm 12 against the stop surface 96 to limit pivotal movement of the pedal arm 12 relative to the pedal support 20 in a return direction opposite arrow A. (FIG. 8).

In order to maintain the coil springs 150, 152 in position relative to the pedal support 20, an inner portion of the housing wall 84*d* is provided with a spring retainer 100. In the illustrated embodiment, the spring retainer 100 includes a cylindrical flange 102 extending from the inner surface of the housing wall 84*d*, a first projection 104 extending from the inner surface and a second projection 106 extending from the first projection 104. The cylindrical flange 102 preferably has an inner diameter somewhat larger than the outer diameter of the larger coil spring 150, the first projection 104 preferably has an outer diameter substantially corresponding to the inner diameter of the larger coil spring 150, and the second projection 106 preferably has an outer diameter substantially corresponding to the inner diameter of the smaller coil spring 152. As should be appreciated, positioning of the larger coil spring 150 between the cylindrical flange 102 and about the first projection 104 maintains the larger coil spring 150 in position relative to the pedal support 20. Similarly, positioning of the smaller coil spring 152 over the second projection 106 maintains the smaller coil spring 152 in position relative to the pedal support 20 and relative to the larger coil spring 150.

In the illustrated embodiment of the invention, the pedal support 20 further includes a supplemental housing 110 configured to contain and protect the magnetic circuit 24 and the magnetic flux sensors 140. In one embodiment, the supplemental housing 110 extends outwardly from the housing side wall 84*a* generally opposite the bearing shaft 86*a* and is positioned generally along the pivot axis P. However, a reverse configuration is also possible wherein the supplemental housing 110 may extend outwardly from the housing side wall 84*b*. In the illustrated embodiment, the supplemental housing 110 is formed integral with the pedal support 20 to define a single-piece, unitary structure. However, in other embodiments of the invention, the supplemental housing 110 may be formed separately and subsequently attached to the pedal support 20 by one or more fasteners or by other attachment techniques. In one embodiment, the supplemental housing 110 includes a hollow inner region 112 in communication with the axial passage 90 extending through the bearing shaft 86*a*, with a surface or shoulder 114 extending about the axial passage 90 and a generally cylindrical-shaped flange 116 extending outwardly from the surface 114. The supplemental housing 110 further includes an outer cylindrical-shaped wall 118 extending from the side wall 84*a* of the pedal housing 84 and surrounding the hollow inner region 112. The outer wall 118 defines a flattened or truncated region 119, the purpose of which will be discussed below.

Figure 6:
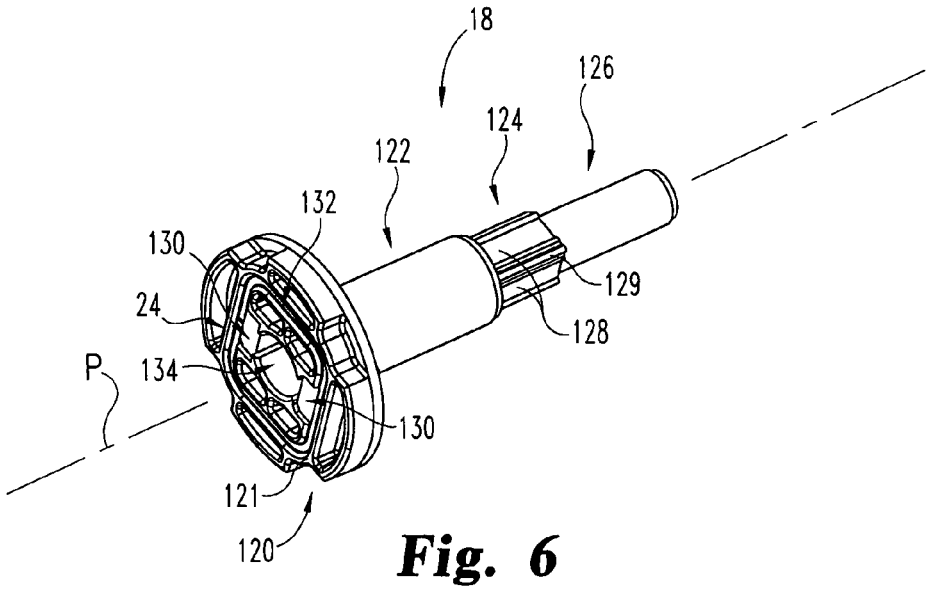
FIG. 6 is a side perspective view of the pivot shaft illustrated in FIGS. 1 and 2 including an integrated magnetic circuit.

Referring to FIGS. 2 and 6, in one embodiment of the invention, the pivot element 18 may be formed from a plastic or polymeric based material, and may be formed via various molding techniques including, for example, injection molding. However, in other embodiments, the pivot element 18 may be formed of composite materials or other materials and/or may be formed via various machining or casting techniques. In the illustrated embodiment of the pedal assembly 10, the pivot element 18 extends generally along the pivot axis P and includes a disc-shaped end portion 120, a first shaft or journal portion 122, a keyed shaft or connecting portion 124, and a second shaft or journal portion 126 extending from the keyed shaft portion 124.

As will be discussed below, the magnetic circuit 24 is engaged within the disc-shaped end portion 120 of the pivot element 18 and is sized for receipt within the hollow inner region 112 of the supplemental housing 110 associated with the pedal support 20. The first journal portion 122 extends from the disc-shaped end portion 120 and has a circular outer cross section sized in relatively close tolerance with the axial passage 90 in the bearing shaft 86*a* of the pedal support 20 to provide for journalled rotation of the pivot element 18 about the pivot axis P. The keyed shaft portion 124 extends from the first journal portion 122 and is sized somewhat smaller than the first journal portion 122. The keyed shaft potion 124 is sized and configured to correspond with the keyed passage 46 in the mounting flange 42 of the pedal arm 12. The keyed shaft portion 124 is matingly engaged within the keyed passage 46 to prevent rotation of the pivot element 18 relative to the pedal arm 12. In the illustrated embodiment, the keyed shaft portion 124 has a generally square-shaped configuration and includes axially-extending grooves 128 which matingly receive the splines 48 formed along the sides of the keyed passage 46. Additionally, the keyed shaft portion 124 is preferably configured to limit insertion of the pivot element 18 within the passage 46 to a select orientation to ensure proper orientation of the pivot element 18 and the associated magnetic circuit 24 relative to the pedal arm 12. In the illustrated embodiment, one corner 129 of the keyed shaft portion is configured as a full corner, whereas the remaining corners are partially removed. The keyed shaft portion 124 is inserted through the keyed passage 46 by aligning the full corner 129 with the fully cut out corner 49 of the keyed passage 46. The second journal portion 126 extends from the keyed shaft portion 124 and is sized somewhat smaller than the keyed shaft portion 124. The second journal portion 126 has a circular outer cross section sized in relatively close tolerance with the axial passage 92 in the bearing shaft 86*b* of the pedal support 20 to provide for journalled rotation of the pivot element 18 about the pivot axis P.

In the illustrated embodiment of the invention, the magnetic circuit 24 is engaged with the disc-shaped end portion 120 of the pivot element 18 and is positioned generally along the pivot axis P such that rotation of the pivot element 18 about the pivot axis P correspondingly rotates the magnetic circuit 24 (and the magnetic field generated by the magnetic circuit 24) about the pivot axis P. In one embodiment, the magnetic circuit 24 includes one or more magnets 130 and an outer loop pole piece or flux ring 132, with the magnets 130 and the pole piece 132 cooperating to generate a magnetic field within the inner region of the loop pole piece 132. The magnetic circuit 24 is particularly well suited for integration into the disc-shaped end portion 120 of the pivot element 18 because of its relatively compact size and its ability to be positioned and arranged along the pivot axis P of the pedal assembly 10. In one embodiment, the magnetic circuit 24 is positioned and arranged such that the magnetic field extends transversely across and intersects the pivot axis P. The magnets 130 are preferably rare earth magnet having a substantially rectangular configuration. Additionally, the loop pole piece 132 is preferably formed of a magnetically permeable material, such as, for example, a soft magnetic steel or cold rolled steel and also has a substantially rectangular configuration. However, it should be understood that other types and configurations of magnets and pole pieces having different shapes and configurations are also contemplated for use in association with the present invention.

Although a particular magnetic circuit 24 has been illustrate and described for use with the pedal assembly 10, it should be understood that other types, configurations and arrangements of magnetic circuits capable of producing a magnetic field are also contemplated for use in association with the present invention. For example, in another embodiment, the magnetic circuit 24 need not necessarily include the loop pole piece 132 to generate a suitable magnetic field. Additionally, it should be understood that the magnetic circuit 24 may include a single magnet or two or more magnets to generate a suitable magnetic field. It should also be understood that the particular magnetic circuit 24 illustrated and described above is exemplary, and that other types and configurations of magnetic circuits are also suitable for use in association with the present invention. For example, U.S. Pat. Nos. 6,137,288, 6,310,473, 6,417,664 and 6,472,865, U.S. Patent Application Publication No. 2003/0132745, and U.S. patent application Ser. No. 10/998,530, all commonly assigned to the Assignee of the subject application, disclose various types and configurations of magnetic circuits suitable for use in association with the present invention, the contents of which are hereby incorporated by reference in their entirety.

In the illustrated embodiment of the invention, the magnetic circuit 24 is attached directly to the pivot element 18, and more specifically to the disc-shaped end portion 120. As should be appreciated, at least the disc-shaped end portion 120 of the pivot element 18 is formed of a non-magnetic material to avoid interference with the magnetic circuit 24. In a specific embodiment of the invention, the magnetic circuit 24 is formed integral with the disc-shaped end portion 120 of the pivot element 18. In one embodiment, the magnetic circuit 24 is insert molded directly into the disc-shaped end portion 120. However, in other embodiments, a cavity may be formed in the disc-shaped end portion 120 into which the magnetic circuit 24 is subsequently press fit or otherwise inserted to form an integrated assembly. It should be understood that other techniques for coupling the magnetic circuit 24 to the disc-shaped end portion 120 of the pivot element 18 are also contemplated as falling within the scope of the present invention.

In embodiments where the magnetic circuit 24 is integrated into the disc-shaped end portion 120 of the pivot element 18, the magnetic circuit 24 is at least partially positioned below the outer axially-facing surface 121 of the disc-shaped end portion 120. In the illustrated embodiment of the pedal assembly 10, the entire magnetic circuit 24 is recessed below the outer surface 121, and a recess 134 is formed in the disc-shaped end portion 120. The recess 134 is arranged generally along the pivot axis P and is sized to receive at least a portion of one or more magnetic flux sensors to position the sensors within the magnetic field generated by the magnetic circuit 24. Although the magnetic circuit 24 is preferably recessed into the disc-shaped end portion 120, it should be understood that the magnetic circuit 24 may alternatively be attached or otherwise engaged to the axially-facing surface 121 or to other regions of the disc-shaped end portion 120. It should further be appreciated that by integrating the magnetic circuit 24 directly into the pivot element 18, stack-up positional tolerances are reduced relative to prior pedal designs that position the magnetic circuit remote from the pivot shaft, thereby potentially reducing manufacturing and assembly costs while improving performance characteristics associated with the pedal assembly 10.

Figure 7:
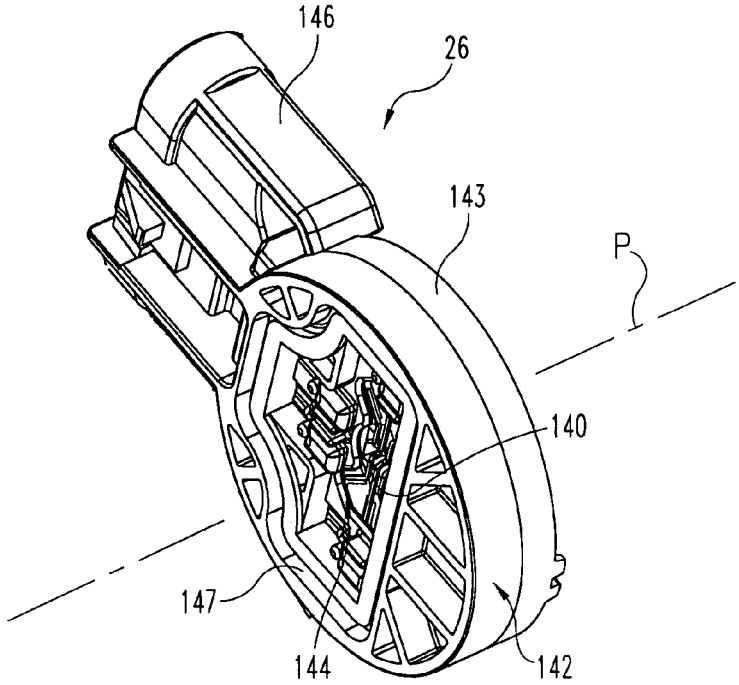
FIG. 7 is a side perspective view of the magnetic sensor device illustrated in FIGS. 1 and 2.

Referring to FIGS. 2 and 7, in the illustrated embodiment of the invention, the non-contact magnetic sensor device 26 includes one or more magnetic flux sensors 140 (extending into the page and arranged along the pivot axis P) that are mounted within a sensor housing 142 which also contains electronic circuitry 144 associated with the operation of the magnetic flux sensors 140. It should be understood that the sensor device 26 may include a single magnetic flux sensor or two or more magnetic flux sensors depending on the requirements of the pedal assembly 10. The sensor housing 142 also includes an integral electrical connector 146 for connecting the electronics associated with the magnetic position sensor 26 with a cable or wire harness, which is in turn connected to electronic equipment or a vehicle control system such as a computer or data processing device. In a preferred embodiment, the electrical connector 146 formed integral with the sensor housing 142 to define a unitary, single-piece structure.

In one embodiment of the sensor device 26, the sensor housing 142 includes a cylindrical-shaped wall 143 defining a hollow inner region (not shown) that is sized and configured for positioning over the cylindrical-shaped wall 118 of the supplemental housing 110 extending from the pedal support 20. In another embodiment, the cylindrical-shaped wall 143 includes a flattened or truncated region (not shown) that is aligned with the flattened or truncated region 119 defined by the supplemental housing wall 118 in order to slip the sensor housing 142 over the supplemental housing 110, thereby ensuring proper orientation and positioning of the magnetic sensor device 26 (including the magnetic flux sensors 140) relative to the pedal support 20 and the magnetic circuit 24. In this manner, the sensor device 26 can be quickly and easily removed from the pedal assembly 10 for replacement by a different sensor device 26 prior to final assembly with the supplemental housing 110. The sensor housing 142 may be snap-fit or press-fit onto the supplemental housing 110 or may be secured to the supplemental housing 110 via one or more fasteners, by an adhesive, or by other securing means known to those of skill in the art.

When the sensor device 26 is properly engaged to the supplemental housing 110 of the pedal support 20, the magnetic flux sensors 140 are arranged generally along the pivot axis P and are positioned within the recess 134 formed in the disc-shaped end portion 120 of the pivot element 18 so as to position the magnetic flux sensors 140 within the magnetic field generated by the magnetic circuit 24. The sensor housing 26 is also preferably provided with a protective cover 148 which fits within a recess 147 formed in the sensor housing 142 to protect the sensor device 26 from the surrounding environment. The protective cover 148 may be secured to the sensor housing 142 via one or more fasteners or by other securing means known to those of skill in the art. Additionally, the protective cover 148 may be formed of a transparent or translucent material to allow for visual inspection of the electronic components positioned within the sensor housing 142 without having to remove the protective cover 148.

For purposes of the present invention, a "magnetic flux sensor" is broadly defined as any device that is operable to sense magnetic flux density and to generate an electronic signal representative of the magnitude of the magnetic flux density. In one embodiment of the invention, the magnetic flux sensors 140 are Hall effect devices that are capable of sensing magnetic flux density passing perpendicularly through the sensing plane of the device. In a specific embodiment, the Hall-effect devices are of the programmable type; however, non-programmable Hall-effect devices are also contemplated for use in association with the present invention. Further details regarding the characteristics and operation of magnetic flux sensors, and particularly a Hall-effect type magnetic flux sensor, are disclosed in U.S. Pat. No. 6,137,288, the contents of which have been incorporated herein in their entirety. It should also be understood that other types of magnetic flux sensors are also contemplated for use in association with the present invention, including, for example, a magneto-resistive (MR) sensor, a magnetic diode sensor, or any other magnetic field-sensitive sensor device that would occur to one of skill in the art.

Referring to FIGS. 2 and 8, in the illustrated embodiment of the invention, the biasing mechanism 22 comprises a pair of nested coil springs 150, 152 arranged generally concentric to one another. Additionally, a spring alignment device 154 (FIG. 2) may be positioned between the inner and outer springs 150, 152 to maintain adequate spacing therebetween and to avoid interference between the coil springs 150, 152. Although the alignment device 154 is illustrated as having a flat configuration, the device 154 is flexible and may be bent into a generally U-shaped configuration, with the legs of the U-shape positioned between the nested coil springs 150, 152 and with the base of the U-shape extending between adjacent coil turns of the inner coil spring 152. It should be understood that other types and arrangements of coil springs are also contemplated for use in association with the present invention, and that any number of coil springs may be used, including a single coil spring or three or more coil springs. It should also be understood that other types of biasing mechanisms that would be apparent to those of ordinary skill in the art are also contemplated for use in association with the present invention. The coil springs 150, 152 are positioned between the flange portion 54 of the clamp arm 14 and the wall portion 84*d* of the pedal housing 84, and are maintained in position relative to the clamp arm 14 and the pedal support 20 via the spring retainers 60 and 100, respectively. As will be discussed further below, the coil springs 150, 152 serve to bias the engagement surfaces 76 of the clamp arm 14 into frictional engagement with the bearing surfaces 88 defined by the pedal support bearing shafts 86*a*, 86*b*.

Having illustrated and described the various components and features associated with the pedal assembly 10, reference will now be made to operation of the pedal assembly 10 according to one form of the present invention. As illustrated in FIG. 8, when the operator of the vehicle exerts an activation force $F_A$ onto the pedal pad 28, the pedal arm 12 will pivot about the pivot axis P in the direction of arrow A. As the pedal arm 12 is pivoted about the pivot axis P, the abutments 34 extending from the proximal lever portion 30*b* will bear against the fulcrums 16*a* and 16*b*, thereby resulting in corresponding rotational movement of the clamp arm 14 about the pivot axis P in the direction of arrow A. As a result of rotational movement of the clamp arm 14 in the direction of arrow A, the clamp arm 14 compresses the coil springs 150, 152 between the flange portion or spring base 54 of the clamp arm 14 and the housing wall 84*d* of the pedal support 20. The coil springs 150, 152 in turn exert a centralized biasing force $F_B$ against the flange portion or spring base 54 of the clamp arm 14. The centralized biasing force $F_B$ exerted onto the flange portion 56, in combination with the engagement of the pedal arm abutments 34 against the clamp arm fulcrums 16*a* and 16*b*, compresses the frictional engagement surfaces 76 of the projections or plateaus 74*a*, 74*b* against the outer bearing surfaces 88 of the pedal support bearing shafts 86*a*, 86*b*. The clamp arm engagement surfaces 76 in turn exert compression forces $F_C$ onto the pedal support bearing surfaces 88, thereby resulting in frictional engagement between the engagement surfaces 76 and the bearing surfaces 88.

As should be appreciated, frictional engagement between the engagement surfaces 76 and the bearing surfaces 88 resists further rotational movement of the clamp arm 14 in the direction of arrow A, which correspondingly results in resistance to further pivotal movement of the pedal arm 12 about the pivot axis P in the direction of arrow A. As should also be appreciated, as the pedal arm 12 is further depressed and pivoted in the direction of arrow A, the coil springs 150, 152 will be compressed to a greater degree, which in turn correspondingly increases the biasing force $F_B$ against the flange portion or spring base 54 of the clamp arm 14. The increased biasing force $F_B$ results in a greater compression force $F_C$ exerted onto the pedal support bearing surfaces 88 by the clamp arm engagement surfaces 76, thereby resulting in increased frictional engagement between the engagement surfaces 76 and the bearing surfaces 88, which will in turn correspondingly increase resistance to further pivotal movement of the pedal arm 12 about the pivot axis P in the direction of arrow A. In other words, as the pedal arm 12 is further depressed and pivoted in the direction of arrow A, resistance to further pivotal movement of the pedal arm 12 in the direction of arrow A is correspondingly increased via the continually increasing biasing force $F_B$ exerted by the coil springs 150, 152 and the continually increasing compression force $F_C$ and frictional forces exerted onto the pedal support bearing surfaces 88 by the clamp arm engagement surfaces 76.

Figure 9:
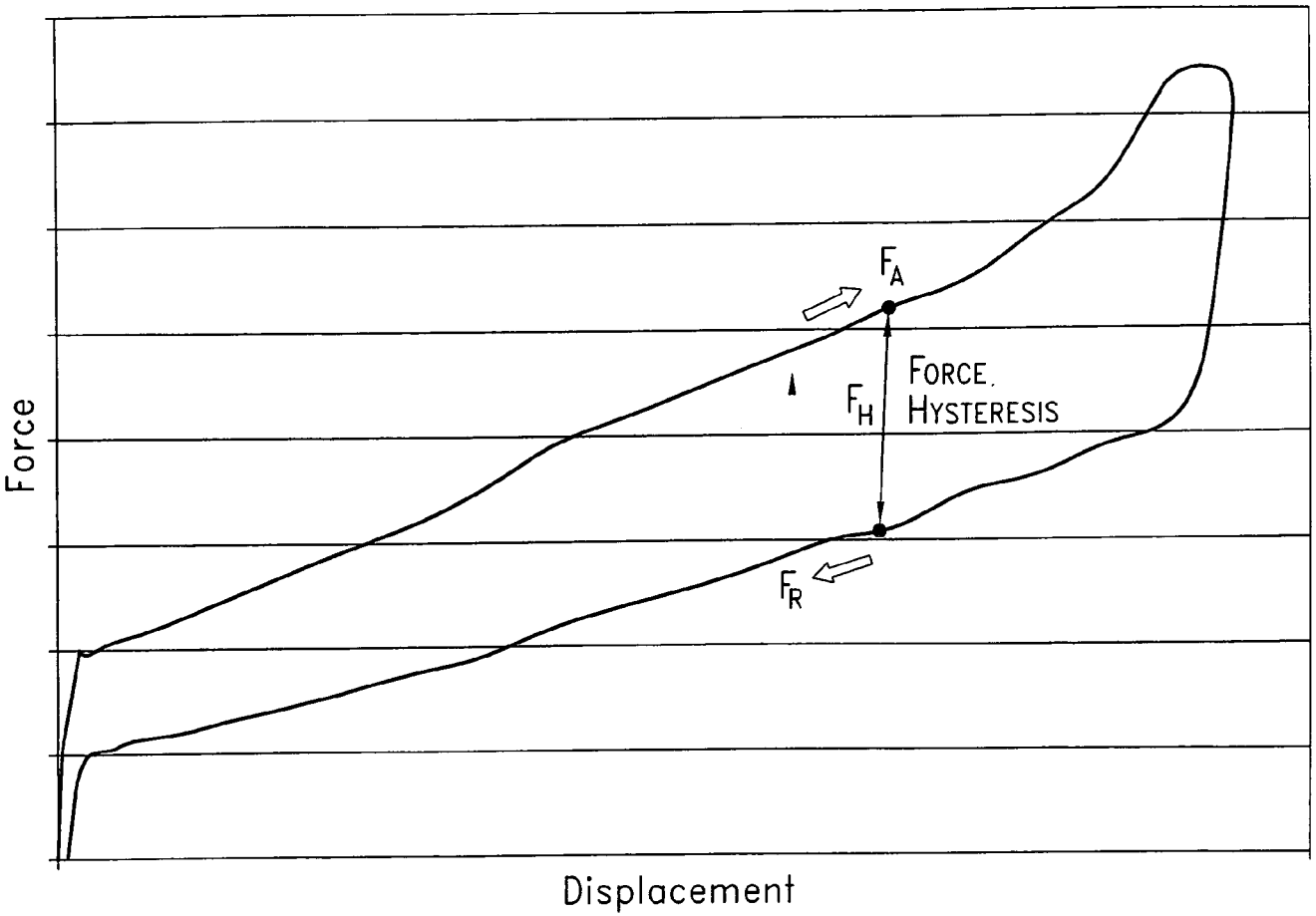
FIG. 9 is an exemplary graph illustrating force hysteresis $F_H$ between a pedal activation force $F_A$ and pedal return force $F_R$ as a function of pedal arm displacement.

When the operator of the vehicle removes or reduces the activation force $F_A$ exerted onto the pedal pad 28, the compressed coil springs 150, 152 will urge the pedal arm 12 and the clamp arm 14 back toward the home or "at rest" position. As should be appreciated, as the coil springs 150, 152 are allowed to return toward their uncompressed state, the biasing force $F_B$ exerted onto the flange portion or spring base 54 of the clamp arm 14 will be correspondingly reduced. As should also be appreciated, a reduction in the biasing force $F_B$ will correspondingly reduce the compression force $F_C$ exerted onto the pedal support bearing surfaces 88 by the clamp arm engagement surfaces 76, thereby lessening frictional engagement between the engagement surfaces 76 and the bearing surfaces 88, which in turn reduces resistance to pivotal movement of the pedal arm 12 back toward the home or "at rest"

position. As should further be appreciated, the force hysteresis $F_H$ at any given position of the pedal arm 12 is the difference between the activation force $F_A$ required to pivot the pedal arm 12 in the direction of arrow A and the return force $F_R$ acting against the operator's foot to return the pedal arm 12 back to the home or "at rest" position. Additionally, it should be understood that the force hysteresis $F_H$ is proportional to the frictional forces developed between the clamp arm engagement surfaces 76 and the pedal support bearing surfaces 88. Accordingly, the amount of force hysteresis $F_H$ associated with the pedal assembly 10 increases as the pedal arm 12 is pivotally displaced in the direction of arrow A. This concept is illustrated in the exemplary force-displacement graph in FIG. 9.

Referring to FIG. 4*b*, shown therein is a cross sectional view of the clamp arm 14 illustrated in FIG. 4*a*, with the bearing shafts 86*a*, 86*b* of the pedal support 20 shown in phantom. FIG. 4*b* illustrates frictional engagement between the engagement surfaces 76 defined by the raised projections or plateaus 74*a*, 74*b* and the outer bearing surfaces 88 defined by the pedal support bearing shafts 86*a*, 86*b* to define two separate and distinct surface contact regions R that are angularly offset from one another relative to the pivot axis P by a separation angle β, with a gap G extending between the surface contact regions R. In one embodiment, the separate and distinct surface contact regions R are arranged along a common circumferential axis extending about the pivot axis P. In a further embodiment, the separate and distinct surface contact regions R extend along a common circumferential plane extending about the pivot axis P. As also indicated above, the fulcrums 16*a*, 16*b* defined by the clamp arm 14 and the laterally extending abutments 34 defined by the pedal arm 12 are configured to provide a sliding pivot between the pedal arm 12 and clamp arm 14. In other words, the fulcrums 16*a*, 16*b* are allowed to slide along the abutments 34, while at the same time allowing pivotal movement of the clamp arm 14 relative to the pedal arm 12. The sliding pivot between the fulcrums 16*a*, 16*b* and the abutments 34 allow pivotal movement of the clamp arm 14 relative to the pedal arm 12 about a variable pivot axis that is displaceable in a direction generally along the bearing surfaces 36 of the abutments 34 to thereby provide an extra degree of freedom or axial movement between the clamp arm 14 and the pedal arm 12 in addition to pivotal movement.

As indicated above, in an alternative embodiment of the pedal assembly 10, the clamp arm 14 need not necessarily be provided with raised projections or plateaus 74*a*, 74*b*. Instead, the frictional engagement surface 76 may be defined by the inner concave surface 72 of the clamp arm 14, thereby defining a single engagement region or patch extending circumferentially about the pivot axis P in lieu of the separate and distinct frictional engagement surfaces 76 provided by each of the raised projections or plateaus 74*a*, 74*b*. However, if the frictional engagement surface is defined by a single engagement region or patch extending circumferentially about the pivot axis P, due to manufacturing variations and dimensional tolerances, the single frictional engagement surface or patch may be uneven or non-uniform (i.e., may not extend precisely about a circumference relative to the pivot axis P). As a result, frictional engagement between the circumferential engagement surface and the respective bearing surfaces 88 defined by the pedal support bearing shafts 86*a*, 86*b* may be uneven or non-uniform, thereby resulting in an uneven or non-uniform distribution of the frictional forces between the clamp arm 14 and the pedal arm 12, which may in turn result in variations in the frictionally-induced hysteresis force characteristics exhibited by the pedal assembly 10. For example, if the circumferential engagement surface is uneven or non-uniform, a high point may be defined along the frictional engagement surface, thereby affecting the frictional force developed between the clamp arm 14 and the pedal support 12, which in turn could affect the frictionally-induced hysteresis force characteristics exhibited by the pedal assembly. If the high point is nearer the fulcrums 16*a*, 16*b*, a higher frictional force would be developed than if the high point were located further from the fulcrums. Although the dimensional tolerances associated with the components of the pedal assembly 10 may be reduced or tightened up to correspondingly reduce the degree of variation between the frictional engagement surfaces defined by the clamp arm 14 and the bearing surfaces 88 defined by the pedal support bearing shafts 86*a*, 86*b*, as should be appreciated, reducing or tightening dimensional tolerances tends to increase manufacturing and assembly costs.

Instead of reducing or tightening the manufacturing or dimensional tolerances associated with the components of the pedal assembly 10, the clamp arm 14 is provided with the raised plateaus 74*a*, 74*b* that are angularly offset or separated from one another by angle βto provide separate and distinct surface contact regions when the clamp arm engagement surfaces 76 are engaged against the pedal support bearing surfaces 88. Additionally, the pedal assembly 10 is provided with a sliding pivot between the fulcrums 16*a*, 16*b* and the abutments 34 to allow for pivotal movement of the clamp arm 14 relative to the pedal arm 12 about a variable pivot axis that is displaceable in a direction generally along the bearing surfaces 36 of the abutments 34. As should be appreciated, the sliding pivot between the fulcrums 16*a*, 16*b* and the abutments 34 allows the frictional engagement surfaces 76 defined by the raised plateaus 74*a*, 74*b* to self-center or self-position about the pivot axis P and relative to the bearing surfaces 88 defined by the pedal support bearing shafts 86*a*, 86*b*, thereby resulting in a more even or uniform distribution of frictional forces between the raised plateaus 74*a*, 74*b* of the clamp arm 14 and the pedal support bearing shafts 86*a*, 86*b*. A more even or uniform distribution of frictional forces between the raised plateaus 74*a*, 74*b* and the pedal support bearing shafts 86*a*, 86*b* in turn tends to reduce variations in the frictionally-induced hysteresis force characteristics exhibited by the pedal assembly 10.

As indicated above, the angular offset (angle β) between the raised plateaus 74*a*, 74*b* of the clamp arm 14 may be varied. In general, the greater the angle β between the raised plateaus 74*a*, 74*b*, the greater the frictional forces developed between the engagement surfaces 76 and the bearing surfaces 88 defined by the pedal support bearing shafts 86*a*, 86*b*, which in turn provides in a greater resistance to pivotal movement of the pedal arm 12 about the pivot axis P, thereby resulting in a greater activation force $F_A$ that must be exerted onto the pedal pad 28 to affect pivotal movement of the pedal arm 12. As should be appreciated, the frictional forces developed between the engagement surfaces 76 and the bearing surfaces 88 will be at a minimum when the angle β is 0 degrees and will correspondingly increase as the angle β is increased to 180 degrees.

Figure 4C:
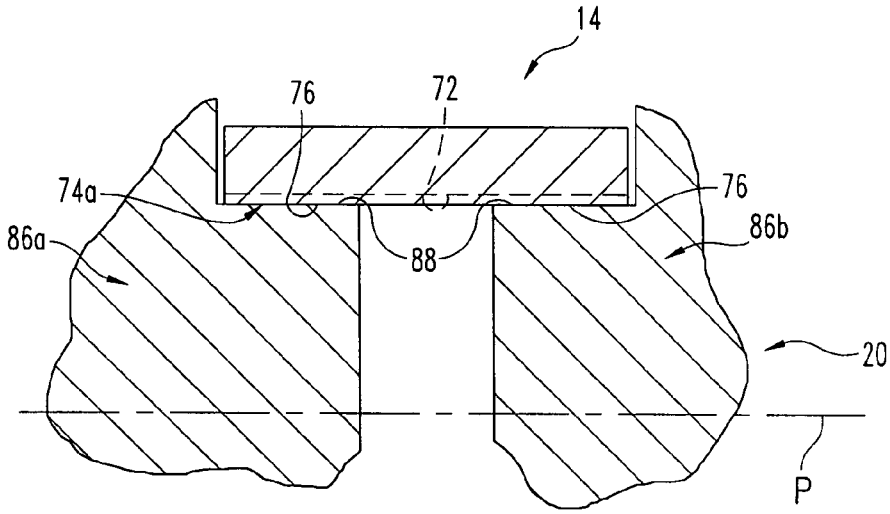
FIG. 4*c* is a cross sectional view of the clamp arm illustrated in FIGS. 4*a* and 4*b*, as taken along lines 4*c*-4*c* of FIG. 4*b* and as engaged with the bearing shaft portions of the pedal support.

Referring to FIG. 4*c*, shown therein is a cross sectional view of the clamp arm 14 illustrated in FIGS. 4*a* and 4*b*, as taken along line 4*c*-4*c* of FIG. 4*b* which extends through the bearing shafts 86*a*, 86*b* of the pedal support 20 and the raised projection or plateau 74*a* defined by the clamp arm 14. Specifically, FIG. 4*c* illustrates frictional engagement between the separate and distinct engagement surfaces 76 defined by the plateau 74*a* and the outer bearing surfaces 88 of the pedal support bearing shafts 86*a*, 86*b*. The engagement surfaces 76 defined by the plateaus 74*a*, 74*b* abut the bearing surfaces 88 of the pedal support bearing shafts 86*a*, 86*b* to define two separate and distinct surface contact regions R (FIG. 4*b*) that provide frictional engagement between the clamp arm 14 and the pedal support bearing shafts 86*a*, 86*b*.

In the illustrated embodiment of the invention, the separate and distinct engagement surfaces 76 are defined by the clamp arm 14. However, in other embodiments, the pedal support bearing shafts 86*a*, 86*b* may be provide with raised projections or plateaus defining separate and distinct engagement surfaces, with the clamp arm 14 defining a substantially continuous circumferential bearing surface. In the illustrated embodiment of the pedal assembly 10, the plateaus 74*a*, 74*b* and the engagement surfaces 76 extend across the entire width of the clamp arm 14. However, in other embodiments, the plateaus 74*a*, 74*b* and the engagement surfaces 76 need only extend across the portions of the clamp arm 14 that are positioned directly above/adjacent the bearing surfaces 88 defined by the pedal support bearing shafts 86*a*, 86*b*. Additionally, in the illustrated embodiment, the frictional engagement surfaces 76 and the bearing surfaces 88 extend in a direction generally parallel with the pivot axis P so as to provide the engagement surfaces 76 and the bearing surfaces 88 with a cylindrical configuration.

Figure 4D:
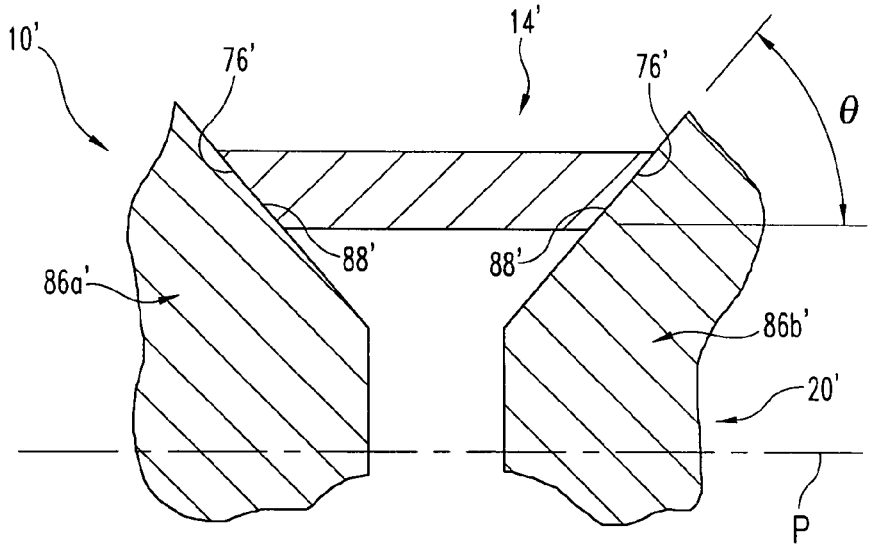
FIG. 4*d* is a cross sectional view of a clamp arm according to another embodiment of the present invention, including conically-shaped engagement surfaces frictionally engaged with conically-shaped bearing surfaces defined by bearing shaft portions of a pedal support.

However, referring to FIG. 4*d*, shown therein is a cross sectional view of another embodiment of a pedal assembly 10' wherein the frictional engagement surfaces 76' defined by the clamp arm 14' and the bearing surfaces 88' defined by the friction elements or bearing shafts 86*a*', 86*b*' are tapered at an oblique angle θ relative to the pivot axis P. In this manner, the frictional engagement surfaces 76' and the bearing surfaces 88' each have a conical configuration. By arranging the frictional engagement surfaces 76' and the bearing surfaces 88' at a taper angle θ, the frictional contact surface area may be increased without having to increase the overall width of the frictional elements 86*a*', 86*b*' of the pedal support 20' and the clamp arm 14'. More specifically, by arranging the frictional engagement surfaces 76' and the bearing surfaces 88' at a taper angle θ, the resulting frictional forces developed between these surfaces will increase by a factor of 1/cos θ. In the illustrated embodiment, the taper angle θ is approximately 45 degrees. However, other taper angles are also contemplated as falling with the scope of the present invention, including taper angles ranging from between 0 degrees to 90 degrees. In a further embodiment of the invention, the frictional engagement surfaces 76' and the bearing surfaces 88' may also be provided with a concave or convex curvature extending generally along the pivot axis P which would also increase the frictional contact surfaced area and the frictional forces developed between the engagement surfaces 76' and the bearing surfaces 88'. It should be understood that the configurations of the engagement surfaces 76' and the bearing surfaces 88' may be modified in other ways to change the frictional characteristics between the clamp arm 14' and the pedal support 20'.

As indicated above, the magnetic flux sensors 140 are positioned within the magnetic field generated by the magnetic circuit 24. The magnetic flux sensors 140 in turn sense varying magnitudes of magnetic flux density as the magnetic circuit 24 and the magnetic field are rotated about the pivot axis P in response to pivotal movement of the pedal arm 12 about the pivot axis P. During rotational displacement of the magnetic circuit 24, the orientation of the sensing planes of the magnetic flux sensors 140 will vary relative to the rotating magnetic field. If Hall devices are used, the sensed magnitude of magnetic flux density is measured in a direction perpendicular to the sensing plane of the Hall element. Accordingly, the sensed magnitude of magnetic flux density will be approximately zero when the sensing planes of the Hall devices are arranged generally parallel with the magnetic field, and will be at its maximum when the sensing planes of the Hall devices are arranged generally perpendicular to the magnetic field.

It should be appreciated that the magnetic field strength or flux density detected by the magnetic flux sensors 140 is proportional to the rotational position of the magnetic field relative to the pivot axis P, which in turn directly corresponds to the pivotal position of the pedal arm 12 relative to the pivot axis P. In a preferred embodiment of the invention, the magnitude of the magnetic flux density sensed by the magnetic flux sensors 140 varies in a substantially linear manner as the magnetic field and the pedal arm 12 are displaced about the pivot axis P. Additionally, in response to variation in the sensed magnitude of magnetic flux density, the sensor device 26 generates an electronic voltage signal that is proportional to the sensed magnitude of magnetic flux density, which is in turn corresponds to the pivotal position of the pedal arm 12 relative to the pedal support 20.

While the present invention has been illustrated and described in detail in the drawings and foregoing description, the same is to be considered as illustrative and not restrictive in character, it being understood that the preferred embodiment has been shown and described and that all changes and modifications that come within the spirit of the invention are desired to be protected.

What is claimed is:

1. A pedal assembly for use in association with a vehicle, comprising:

a pedal support adapted for mounting to the vehicle;

a pedal member including a lever portion and a mounting portion, said mounting portion rotatably coupled to said pedal support to allow pivotal movement of said pedal member about a first pivot axis;

a friction member having a bearing surface;

a clamp member pivotally engaged with said pedal member by at least one pivot element to provide pivotal displacement of said clamp member relative to said pedal member about a second pivot axis offset from said first pivot axis, said clamp member having an engagement surface abutting said bearing surface of said friction member to define at least two separate and distinct surface contact regions angularly offset from one another relative to said first pivot axis, wherein said clamp member includes at least two raised projections that are positioned in abutment against said bearing surface of said friction member to define said at least two separate and distinct surface contact regions, and wherein said at least two separate and distinct surface contact regions are arranged along a common circumferential axis extending about said first pivot axis, and wherein said surface contact regions are separated from one another by a circumferential gap defined between said clamp member and said friction member and extending along said circumferential axis, said circumferential gap including an inner non-contact surface region that is radially spaced from said friction member when said contact regions are engaged with said friction member.

2. The pedal assembly of claim 1, wherein said clamp member is engaged with said pedal member by a sliding pivot configured to allow said clamp member to be pivotally and slidably displaced relative to said pedal member during said pivotal movement of said pedal member.

3. The pedal assembly of claim 2, wherein said at least one pivot element of said clamp member comprises at least one fulcrum member, said pedal member including at least one abutment, said fulcrum member engaged with said abutment to provide said sliding pivot.

4. The pedal assembly of claim 1, wherein said at least two separate and distinct surface contact regions are angularly offset from one another by an angle falling within a range of between about 45 degrees and about 135 degrees.

5. The pedal assembly of claim 4, wherein said at least two separate and distinct surface contact regions are angularly offset from one another by an angle falling within a range of between about 60 degrees and about 120 degrees.

6. The pedal assembly of claim 5, wherein said at least two separate and distinct surface contact regions are angularly offset from one another by about 90 degrees.

7. The pedal assembly of claim 1, wherein said second pivot axis comprises a variable pivot axis wherein said clamp member is allowed to be pivotally and slidably displaced relative to said pedal member during said pivotal movement of said pedal member.

8. The pedal assembly of claim 7, wherein said at least two separate and distinct surface contact regions extend along a common circumferential plane extending about said first pivot axis.

9. The pedal assembly of claim 1, wherein said circumferential gap extends annularly about said first pivot axis.

10. The pedal assembly of claim 1, wherein application of an activation force onto said lever portion imparts pivotal movement of said pedal member about said first pivot axis, said pivotal movement imparting rotational movement of said clamp member about said first pivot axis while maintaining said frictional engagement along said at least two separate and distinct surface contact regions, said rotational movement increasing a biasing force applied to said clamp member by a biasing member to correspondingly increase said frictional engagement along said at least two separate and distinct surface contact regions to provide increased resistance to further pivotal movement of said pedal member about said first pivot axis; and wherein a reduction in said activation force onto said lever portion of said pedal member allows said biasing member to pivot said pedal member about said first pivot axis toward an at rest position, said pivotal movement of said pedal member toward said at rest position decreasing said biasing force exerted onto said clamp member by said biasing member to correspondingly decrease said frictional engagement along said at least two separate and distinct surface contact regions to provide decreased resistance to further pivotal movement of said pedal member about said first pivot axis toward said at rest position.

11. The pedal assembly of claim 10, wherein said biasing member comprises at least one compression spring.

12. The pedal assembly of claim 1, wherein said friction member is integral with said pedal support.

13. The pedal assembly of claim 1, wherein said clamp member includes a yoke portion defined by pair of pedal mounting portions that are laterally interconnected by a bearing portion defining said engagement surface, said lever portion of said pedal member positioned within said yoke portion with said mounting portions engaged with corresponding portions of said lever portion.

14. The pedal assembly of claim 1, further comprising:

a magnetic field generator providing a magnetic field, said magnetic field generator coupled to said pedal member and arranged generally along said first pivot axis such that said pivotal movement of said pedal member results in corresponding rotational displacement of said magnetic field about said first pivot axis; and a magnetic sensor device comprising at least one magnetic flux sensor arranged generally along said first pivot axis and positioned within said magnetic field to sense variations in said magnetic field during said rotational displacement and to generate an output signal representative of a rotational position of said magnetic field relative to said at least one magnetic flux sensor.

15. The pedal assembly of claim 14, further comprising a pivot member extending along said first pivot axis, said pivot member non-rotatably coupled with said mounting portion of said pedal member and rotatably coupled to said pedal support to allow said pivotal movement of said pedal member about said first pivot axis, said magnetic field coupled with said pivot member such that said pivotal movement of said pedal member results in said rotational displacement of said magnetic field about said first pivot axis.

16. The pedal assembly of claim 15, wherein said magnetic field generator is integrally engaged directly with said pivot member.

17. The pedal assembly of claim 1, wherein said clamp member includes a yoke opening arranged along a longitudinal axis and defined between a pair of pedal mounting portions positioned on opposite sides of said longitudinal axis, said lever portion of said pedal member positioned within said yoke opening with said mounting portions positioned in engagement with corresponding portions of said lever portion, said clamp member including a bearing portion laterally interconnecting said mounting portions and defining said engagement surface abutting said bearing surface of said friction member, said clamp member including a central flange portion extending axially from said bearing portion and centrally positioned between said mounting portions along said longitudinal axis and generally aligned with said yoke opening; and a biasing member arranged along said longitudinal axis and exerting a centralized biasing force to said central flange portion of said clamp member to bias said clamp member toward said friction member to provide frictional engagement between said engagement surface and said bearing surface to resist said pivotal movement of said pedal member.

18. The pedal assembly of claim 17, wherein said clamp member includes a pair of opposing fulcrum portions extending inwardly from said pedal mounting portions and into said yoke opening, said fulcrum portions engaged against corresponding abutments defined by said lever portion.

19. The pedal assembly of claim 17, wherein said mounting portions of said clamp ann and said corresponding portions of said lever portion are configured to provide a sliding pivot to allow said clamp member to be pivotally and slidably displaced relative to said pedal member during said pivotal movement of said pedal arm.

20. The pedal assembly of claim 1, wherein said at least two separate and distinct surface contact regions are non-symmetrically angularly offset from one another along said circumferential axis.

21. The pedal assembly of claim 1, wherein said at least two raised projections of said clamp member are simultaneously compressed against said bearing surface of said friction member to provide said at least two separate and distinct surface contact regions.

22. A pedal assembly for use in association with a vehicle, comprising:

a pedal support adapted for mounting to the vehicle;

a pedal member including a lever portion and a mounting portion, said mounting portion pivotally coupled to said pedal support to allow pivotal movement of said pedal member relative to said pedal support about a first pivot axis;

a friction member having a bearing surface; and a clamp member pivotally engaged with said pedal member to provide pivotal displacement of said clamp member relative to said pedal member about a second pivot axis, said clamp member having an engagement surface abutting said bearing surface of said friction member to define at least two separate and distinct surface contact regions angularly offset from one another relative to said first pivot axis and arranged along a common circumferential axis extending about said first pivot axis, wherein said clamp member includes at least two raised projections that are positioned in abutment against said bearing surface of said friction member to define said at least two separate and distinct surface contact regions, and wherein said surface contact regions are separated from one another by a circumferential gap extending along said circumferential axis and including an inner non-contact surface region that is radially spaced from said friction member when said contact regions are engaged with said friction member.

23. The pedal assembly of claim 22, further comprising a pivot member non-rotatably coupled with said mounting portion of said pedal member and rotatably coupled to said pedal support to allow said pivotal movement of said pedal member relative to said pedal support about said first pivot axis.

24. The pedal assembly of claim 23, further comprising:

a magnetic field generator providing a magnetic field, said magnetic field generator coupled to said pivot member and arranged generally along said first pivot axis such that said pivotal movement of said pedal member results in corresponding rotational displacement of said magnetic field about said first pivot axis; and a magnetic sensor device comprising at least one magnetic flux sensor arranged generally along said first pivot axis and positioned within said magnetic field to sense variations in said magnetic field during said rotational displacement and to generate an output signal representative of a rotational position of said magnetic field relative to said at least one magnetic flux sensor;

wherein said magnetic field generator includes at least one magnet and a loop pole piece defining an inner region, said magnet cooperating with said loop pole piece to generate said magnetic field within said inner region, said inner region of said loop pole piece positioned along said first pivot axis with said magnetic field transversely intersecting said first pivot axis; and wherein said loop pole piece comprises a flux ring extending about said inner region with said first pivot axis intersecting said inner region and with said magnet positioned within said inner region.

25. The pedal assembly of claim 23, wherein said mounting portion of said pedal member defines a non-circular keyed passage extending along said first pivot axis, said pivot member including a non-circular keyed shaft extending through said non-circular keyed passage to non-rotatably couple said pivot member with said pedal member.

26. The pedal assembly of claim 22, further comprising a biasing member arranged to apply a biasing force to said clamp member to bias said clamp member toward said friction member to provide frictional engagement between said engagement surface and said bearing surface to resist said pivotal movement of said pedal member.

27. The pedal assembly of claim 22, wherein said at least two separate and distinct surface contact regions extend along a common circumferential plane extending about said first pivot axis.

28. The pedal assembly of claim 22, wherein said circumferential gap extends annularly about said first pivot axis.

29. The pedal assembly of claim 22, wherein said at least two separate and distinct surface contact regions are non-symmetrically angularly offset from one another along said circumferential axis.

30. The pedal assembly of claim 22, wherein said at least two raised projections of said clamp member are simultaneously compressed against said bearing surface of said friction member to provide said at least two separate and distinct surface contact regions.

* * * * *